US007591214B2

(12) United States Patent
Ando et al.

(10) Patent No.: US 7,591,214 B2
(45) Date of Patent: Sep. 22, 2009

(54) DRIVING MOTOR CONTROLLING DEVICE OF CONSTRUCTION MACHINE

(75) Inventors: Teruhisa Ando, Gifu (JP); Nobuaki Shimizu, Gifu (JP); Masahiro Tsunemi, Gifu (JP); Hitoshi Yamaguchi, Hyogo (JP)

(73) Assignee: Nabtesco Corporation, Tokyo (JP)

( * ) Notice: Subject to any disclaimer, the term of this patent is extended or adjusted under 35 U.S.C. 154(b) by 435 days.

(21) Appl. No.: 11/392,481

(22) Filed: Mar. 29, 2006

(65) Prior Publication Data

US 2006/0218916 A1 Oct. 5, 2006

(30) Foreign Application Priority Data

Mar. 31, 2005 (JP) ..... 2005-103304
Mar. 31, 2005 (JP) ..... 2005-103305
Mar. 31, 2005 (JP) ..... 2005-103306

(51) Int. Cl.
*F15B 13/042* (2006.01)

(52) U.S. Cl. ..... 91/431; 91/433; 60/460

(58) Field of Classification Search ..... 60/460, 60/466; 91/431, 433
See application file for complete search history.

(56) References Cited

U.S. PATENT DOCUMENTS 4,041,983 A * 8/1977 Bianchetta ..... 91/433
4,738,103 A * 4/1988 Tha ..... 60/460
5,282,363 A * 2/1994 Ogawa et al. ..... 60/420
5,410,878 A * 5/1995 Lee et al. ..... 60/329

FOREIGN PATENT DOCUMENTS

EP 0494070 A2 8/1992
JP 60-249707 A 12/1985

OTHER PUBLICATIONS

Patent Abstracts of Japan; English Translation of Abstract of Japanese Publ. No. 60-249707; Dated Dec. 10, 1985; (2 pages).

* cited by examiner

*Primary Examiner*—F. Daniel Lopez
(74) *Attorney, Agent, or Firm*—Osha • Liang LLP

(57) ABSTRACT

Provided is a driving motor controlling device of a construction machine, including a driving motor which is included in the construction machine having a swivel joint interposed between an upper body and a lower body, and is connected to a pump and a tank through the swivel joint, and a motor control valve which switches a state for connecting the pump and the tank to the driving motor such that the driving motor is controlled to a stop state, a normal rotation state, or a reverse rotation state, wherein the motor control valve has a neutral position for the stop state, a normal rotation position for the normal rotation state, and a reverse rotation position for the reverse rotation state, and is switched to the neutral position, the normal rotation position, or the reverse rotation position, based on a command from a control device manipulated by a operator and a pressure of an inflow side of hydraulic oil into the driving motor, wherein the motor control valve is disposed in the lower body in which the driving motor is disposed, and is integrally formed with the driving motor, and wherein, upon a warming up operation, the hydraulic oil discharged from the pump is circulated to the tank disposed in the upper body through the swivel joint and the motor control valve.

4 Claims, 4 Drawing Sheets

DRIVING MOTOR CONTROLLING DEVICE OF CONSTRUCTION MACHINE

BACKGROUND OF THE INVENTION

1. Technical Field

The present invention relates to a driving motor controlling device of a construction machine, which has a driving motor connected to a pump and a tank through a swivel joint and a motor control valve for switching a state for connecting the pump and the tank to the driving motor such that the driving motor is controlled to any one of a stop state, a normal rotation state, and a reverse rotation state.

2. Related Art

A driving motor controlling device of a construction machine (hereinafter, referred to as driving motor controlling device) which has a driving motor and a motor control valve for controlling an operation state of the driving motor is known as an example of related art (see Japanese Unexamined Patent Application Publication No. 60-249707). In the driving motor controlling device disclosed in Japanese Unexamined Patent Application Publication No. 60-249707, the motor control valve is integrally formed with control valves for controlling the operation of actuators different from the driving motor, and disposed in an upper body of the construction machine which is higher than a swivel joint. When the construction machine having the driving motor controlling device is operated in an environment which a temperature is low, such as a cold region in winter, since viscosity of hydraulic oil becomes higher upon start-up, a warming up operation is first performed. When the warming up operation is performed, hydraulic oil is circulated from the pump to the tank through the control valves and thus becomes warm.

However, in the construction machine having the driving motor controlling device disclosed in Japanese Unexamined Patent Application Publication No. 60-249707, when the warming up operation is performed, the hydraulic oil is circulated from the pump to the tank through the control valves, but is not circulated from the motor control valve to the driving motor. Accordingly, the hydraulic oil which becomes warm by the warming up operation does not flow between the motor control valve and the driving motor and thus the motor control valve and the driving motor remains cold even when the warming up operation is performed. At this state, when the construction machine begins to be driven, the warm hydraulic oil is rapidly fed to the cold driving motor and thus heat balance of the driving motor is lost. In other words, a portion of the driving motor which is in contact with the warm hydraulic oil rapidly becomes warm, whereas the other thereof remains cold. In the driving motor controlling device disclosed in Japanese Unexamined Patent Application Publication No. 60-249707, when the construction machine begins to be driven after the warming up operation, an operation fault or failure of the driving motor may be caused due to a difference in thermal expansion.

In addition, a counterbalance valve was generally used for preventing cavitation of the driving motor from being created. However, in order to simplify the structure of the valve, the driving motor controlling device disclosed in Japanese Unexamined Patent Application Publication No. 60-249707 realizes a structure for preventing cavitation from being created although the counterbalance valve is not used. In this driving motor controlling device, a main selector valve 14A provided in a circuit for connecting a hydraulic pump 10A to an actuator 12 which is a hydraulic motor is switched by controlling a pilot valve 28. Furthermore, pressure reduction valves 30*a* and 30*b* which reduce a set pressure in a conduit line between a pilot valve 28 and a pilot chamber provided at the both sides of the main selector valve 14A according to the reduction in the pump pressure which is caused by the hydraulic oil from the pump 10A are provided.

However, in the driving motor controlling device disclosed in Japanese Unexamined Patent Application Publication No. 60-249707, in order to allow the main selector valve 14A to be switched from a neutral position, the pressure reduction valves 30*a* and 30*b* need be formed such that passages 26*a* and 26*b* between the remote control valve 28 and the pilot chamber of the main selector valve 14A are sufficiently communicated with each other in an initial state of the switching operation in which a load is not generated in a passage 56 of a discharge side of the pump 10A. In this driving motor controlling device, when the construction machine begins to be self-propelled on a downhill road to reduce the pressure of the passage 56, the pressure may not be sufficiently reduced by the pressure reduction valves 30*a* and 30*b* in the initial state of the switching operation and the cavitation may be created in the driving motor.

In order to prevent the cavitation from being created due to the above-described reason, the pressure reduction valves 30*a* and 30*b* may be formed such that an opening degree of the passage 56 between the remote control valve 28 and the pilot chamber of the main selector valve 14A is reduced in the initial state of the switching operation. However, when the pressure reduction valves 30*a* and 30*b* are formed as described above, a pilot pressure which acts on the pilot chamber of the main selector valve 14A is reduced in the initial state of the switching operation (hydraulic oil fed to the pilot chamber is reduced) and thus the switching operation of the main selector valve 14A is delayed and rising of a driving speed upon the start-up is delayed.

SUMMARY OF THE INVENTION

A first advantage of the present invention is to provide a driving motor controlling device of a construction machine, which is capable of suppressing heat balance of a driving motor from being lost when the construction machine begins to be driven after a warming up operation and suppressing an operation fault or failure of the driving motor due to a difference in thermal expansion in the driving motor.

A second advantage of the present invention is to provide a driving motor controlling device of a construction machine, which is capable of more surely suppressing cavitation from being created although a counterbalance valve is not used and preventing rising of a driving speed from being delayed upon start-up.

According to a first aspect of the invention for realizing the first advantage, there is provided a driving motor controlling device of a construction machine, included in the construction machine having a swivel joint interposed between an upper body and a lower body, the device comprising including a driving motor which is connected to a pump and a tank through the swivel joint, and a motor control valve which switches a state for connecting the pump and the tank to the driving motor such that the driving motor is controlled to a stop state, a normal rotation state, or a reverse rotation state, wherein the motor control valve has a neutral position for the stop state, a normal rotation position for the normal rotation state, and a reverse rotation position for the reverse rotation state, and is switched to the neutral position, the normal rotation position, or the reverse rotation position, based on a command from a control device manipulated by a operator and a pressure of an inflow side of hydraulic oil into the driving motor, wherein the motor control valve is disposed in the lower body in which the driving motor is disposed, and is integrally formed with the driving motor, and wherein, upon a warming up operation, the hydraulic oil discharged from the pump is circulated to the tank disposed in the upper body through the swivel joint and the motor control valve.

By this configuration, when a warming up operation of the construction machine is performed, the hydraulic oil discharged from the pump to the motor control valve disposed in the lower body in which the driving motor is disposed is circulated. Accordingly, the motor control valve becomes warm by the hydraulic oil which becomes warm by circulation, and thus the driving motor integrally formed with the motor control valve becomes warm. By this configuration, in the driving motor controlling device of the construction machine, when the construction machine begins to be driven after the warming up operation, the heat balance of the driving motor is prevented from being lost and thus the operation fault or failure of the driving motor due to the difference in the thermal expansion in the driving motor can be suppressed.

The motor control valve may be tandem-connected or serial-connected to control valves of hydraulic actuators different from the driving motor and may be provided at downstream of the control valves of the hydraulic actuators.

By this configuration, the hydraulic oil fed from the pump passes through the control valve of the hydraulic actuators and is fed to the motor control valve. Accordingly, pressure loss due to the length of the pipe which more becomes longer by a length corresponding to the motor control valve disposed in the lower body does not affect the hydraulic actuators. Therefore, it is possible to suppress energy efficiency from be reduced.

Furthermore, according to a second aspect of the invention, there is provided a driving motor controlling device of a construction machine, included in the construction machine having a swivel joint interposed between an upper body and a lower body, the device comprising a driving motor which is connected to a pump and a tank through the swivel joint, and a motor control valve which switches a state for connecting the pump and the tank to the driving motor such that the driving motor is controlled to a stop state, a normal rotation state, or a reverse rotation state, wherein the motor control valve has a neutral position for the stop state, a normal rotation position for the normal rotation state, and a reverse rotation position for the reverse rotation state, and is switched to the neutral position, the normal rotation position, or the reverse rotation position, based on a command from a control device manipulated by a operator and a pressure of an inflow side of hydraulic oil into the driving motor.

The driving motor controlling device of the construction machine related to the second aspect of the invention has the following several features in order to realize the first advantage. In other words, the driving motor controlling device of the construction machine related to the second aspect of the invention has each of the following features or a combination thereof.

A first feature of the driving motor controlling device of the construction machine related to the second aspect of the invention for realizing the first advantage is as follows: The driving motor controlling device further includes an electrical remote controller which is the control device for converting an amount controlled by the operator into an electrical signal; a detector which detects the pressure of the inflow side and converts the pressure into an electrical signal; a control unit which outputs a control signal based on the electrical signal from the electrical remote controller and the electrical signal from the detector; and an electro-hydraulic valve which generates a pilot pressure based on the control signal from the control unit, the motor control valve is disposed in the lower body in which the driving motor is disposed, and is integrally formed with the driving motor, and, upon a warming up operation, the hydraulic oil discharged from the pump is circulated to the tank disposed in the upper body through the swivel joint and the motor control valve.

By this configuration, when a warming up operation of the construction machine is performed, the hydraulic oil discharged from the pump to the motor control valve disposed in the lower body in which the driving motor is disposed is circulated. Accordingly, the motor control valve becomes warm by the hydraulic oil which becomes warm by circulation, and thus the driving motor integrally formed with the motor control valve becomes warm. By this configuration, in the driving motor controlling device of the construction machine, when the construction machine begins to be driven after the warming up operation, the heat balance of the driving motor is prevented from being lost and thus the operation fault or failure of the driving motor due to the difference in the thermal expansion in the driving motor can be suppressed.

In addition, when the construction machine is switched from the driving state to the stop state on a downhill road, an outflow side of the hydraulic oil from the driving motor has a high pressure. Accordingly, the existing driving motor controlling device of the construction machine need use a pipe which has a high strength to bear up against the high pressure between the motor control valve and the driving motor. Thus, an expensive pipe is required. However, according to the driving motor controlling device, since the motor control valve is integrally formed with the driving motor, a pipe for connecting the motor control valve and the driving motor is not required.

Furthermore, by this configuration, the electro-hydraulic valve is controlled to generate the pilot pressure based on a command from the electrical remote controller by the control unit and the result of detecting the pressure of the inflow side of the driving motor by the detector. Thus, the motor control valve can be operated by the pilot pressure. Accordingly, response delay is low and the motor control valve can be accurately or rapidly operated based on the pressure of the inflow side of the driving motor and the command from the electrical remote controller which is the control device.

A second feature of the driving motor controlling device of the construction machine related to the second aspect of the invention is as follows: The control unit and the electro-hydraulic valve are disposed in the upper body, the detector is mounted in the driving motor, the detector and the control unit are connected to each other through a snap ring disposed in the swivel joint, and the electro-hydraulic valve and the motor control valve are connected to each other through the swivel joint.

By this configuration, since the detector for detecting the pressure of the inflow side of the driving motor is mounted in the driving motor, detection of the pressure can be more suppressed from being delayed, compared with a case where the pipe is provided from the inflow side of the driving motor to the upper body through the swivel joint to be connected to the detector. In addition, a response to the change in the pressure of the inflow side of the driving motor is suppressed from being delayed and thus the motor control valve can be rapidly operated with respect to the change in the pressure of the inflow side of the driving motor, thereby suppressing cavitation from being created in the driving motor. In addition, the response to the change in the pressure of the inflow side of the driving motor is suppressed from being delayed and thus hunting can be suppressed from being generated in the operation of the motor control valve.

A third feature of the driving motor controlling device of the construction machine related to the second aspect of the invention is as follows: The motor control valve has a detecting port which is connected to the detector and induces the pressure of the inflow side detected by the detector, and wherein, in the normal rotation state, the detecting port is connected to a passage which becomes the inflow side in the normal rotation state, and in the reverse rotation state, the detecting port is connected to another passage which becomes the inflow side in the reverse rotation state.

By this configuration, the pressure of the inflow side of the driving motor which is induced to the detector is selected by the motor control valve and thus the passage which becomes the inflow side in the normal rotation position and the passage which becomes the inflow side in the reverse rotation position need not have the respective detectors, thereby sharing the detector.

In addition, a fourth feature of the driving motor controlling device of the construction machine related to the second aspect of the invention is as follows: A negative brake which is operated in the stop state is connected to the detecting port.

By this configuration, by combining a port for the negative brake and a port for the detecting port, the number of the ports may not increase in mounting the detector, thereby preventing the device from being enlarged.

According to a third aspect of the invention, there is provided a driving motor controlling device of a construction machine, including a driving motor which is connected to a pump and a tank through a swivel joint, and a motor control valve which switches a state for connecting the pump and the tank to the driving motor such that the driving motor is controlled to a stop state, a normal rotation state, or a reverse rotation state, and wherein the motor control valve has a neutral position for the stop state, a normal rotation position for the normal rotation state, and a reverse rotation position for the reverse rotation state, and is switched to the neutral position, the normal rotation position, or the reverse rotation position, based on a command from a control device manipulated by a operator and a pressure of an inflow side of hydraulic oil into the driving motor.

The driving motor controlling device of the construction machine related to the third aspect of the invention has the following several features in order to realize the second advantage. In other words, the driving motor controlling device of the construction machine related to the third aspect of the invention has each of the following features or a combination thereof.

A first feature of the driving motor controlling device of the construction machine related to the third aspect of the invention for realizing the second advantage is as follows: The driving motor controlling device further includes a remote control valve which is the control device for generating a pilot pressure; a first pilot chamber which is provided in the motor control valve and on which the pilot pressure for switching and operating the motor control valve acts; a pilot pressure control valve which switches a connection state between the remote control valve and the first pilot chamber and has a discharge position for connecting the first pilot chamber to the tank and a feed position for connecting the remote control valve to the first pilot chamber; a spring which is disposed at one side of the pilot pressure control valve to bias the pilot pressure control valve toward the discharge position; a second pilot chamber which is disposed at the other side of the pilot pressure control valve and on which the pressure of the inflow side acts such that the pilot pressure control valve is biased toward the feed position; and a starting passage which connects the remote control valve to the first pilot chamber through the motor control valve, and the remote control valve is connected to the first pilot chamber through the starting passage until the pilot pressure control valve is switched to the feed position, and the starting passage is blocked by the motor control valve when the pilot pressure control valve is switched to the feed position.

The remote control valve is connected to the first pilot chamber through the starting passage even until the pilot pressure control valve is switched to the feed position. Accordingly, the pilot pressure control valve can be formed such that the opening in the discharge position becomes narrower or is blocked and thus a sufficient pilot pressure can act on the first pilot chamber even until the pilot pressure control valve is switched to the feed position. Thus, it is possible to prevent the rising of the driving speed from be delayed due to the delay of the switching operation in an initial state of a time when the motor control valve is switched from the neutral position. After the pilot pressure control valve is switched to the feed position, the starting passage is blocked by the motor control valve and thus the pilot pressure acts on the first pilot chamber only through the pilot pressure control valve.

When the construction machine begins to be self-propelled and thus the pressure of the inflow side of the hydraulic oil into the driving motor is reduced, the pressure of the hydraulic oil acting on the second pilot chamber is reduced. Accordingly, the pilot pressure control valve is switched to the discharge position by the bias force of the spring and thus the passage between the remote controller valve and the pilot chamber more becomes narrower or is blocked. Thus, the motor control valve is moved toward the neutral position and thus the outflow side of the hydraulic oil from the driving motor becomes narrower. Accordingly, it is possible to suppress the cavitation of the driving motor from being created.

Accordingly, by this configuration, it is possible to provide a driving motor controlling device of a construction machine which is capable of more surely suppressing the cavitation from being created although the counterbalance valve is not used in the driving motor controlling device of the construction machine and preventing the rising of the driving speed upon the start-up from being delayed.

In addition, a second feature of the driving motor controlling device of the construction machine related to the third aspect of the invention is as follows: When the motor control valve is switched from the neutral position to the normal rotation position or the reverse rotation position, the starting passage is blocked and an outflow side of the hydraulic oil from the driving motor is then connected to the tank.

By this configuration, when the motor control valve is switched from the neutral position, the starting passage is first blocked and the outflow side of the driving motor and the tank are then connected to each other. Accordingly, even when the construction machine begins to be self-propelled upon the switching operation and thus the pressure of the outflow side of the driving motor is reduced, the outflow side of the driving motor is blocked by the motor control valve until the starting passage is blocked. Thus, the cavitation can be more suppressed from being created.

Furthermore, a third feature of the driving motor controlling device of the construction machine related to the third aspect of the invention is as follows: When the motor control valve is switched from the neutral position to the normal rotation position or the reverse rotation position, an outflow side of the hydraulic oil from the driving motor is connected to the tank and the starting passage is then blocked.

By this configuration, although the construction machine begins to be self-propelled upon the switching operation, the pressure of the outflow side of the driving motor is reduced, and thus the pilot pressure control valve is not sufficiently switched to the feed position, since the pilot pressure acts on the first pilot chamber through the starting passage, the outflow side of the driving motor in the motor control valve is not rapidly blocked and thus impact can be suppressed from being generated.

Furthermore, the driving motor controlling device of the construction machine related to the third aspect of the invention is characterized in that the motor control valve is a center bypass control valve, and an opening degree of a center bypass passage is set such that, when the starting passage is blocked, the pressure which can switch the pilot pressure control valve to the feed position against a bias force of the spring is generated in the inflow side of the driving motor and acts on the second pilot chamber, even in a state that a discharge amount of the pump is a minimum.

By this configuration, since a path in which the pilot pressure acts on the first pilot chamber can be smoothly switched to a passage from the starting passage through the pilot pressure control valve, impact generated upon the start-up of the driving motor, that is, impact generated when switching the pilot pressure control valve can be reduced.

In addition, in a case where the invention applies to the driving motor controlling device of the construction machine having the second feature, before the driving motor is initiated and the outflow side is opened, the path in which the pilot pressure acts on the first pilot chamber is switched to the passage through the pilot pressure control valve. Thus, it is possible to prevent impact from being generated in the driving motor when switching the pilot pressure control valve.

Furthermore, the above and other objects, features and advantages of the invention will be more apparent from the following description, referring to the accompanying drawings.

BRIEF DESCRIPTION OF THE DRAWINGS

The invention will be described with reference to the accompanying drawings, wherein like numbers reference like elements, and wherein.

DESCRIPTION OF THE PREFERRED EMBODIMENTS

Hereinafter, embodiments according to the invention will be described with reference to the accompanying drawings.

First Embodiment

Figure 1:
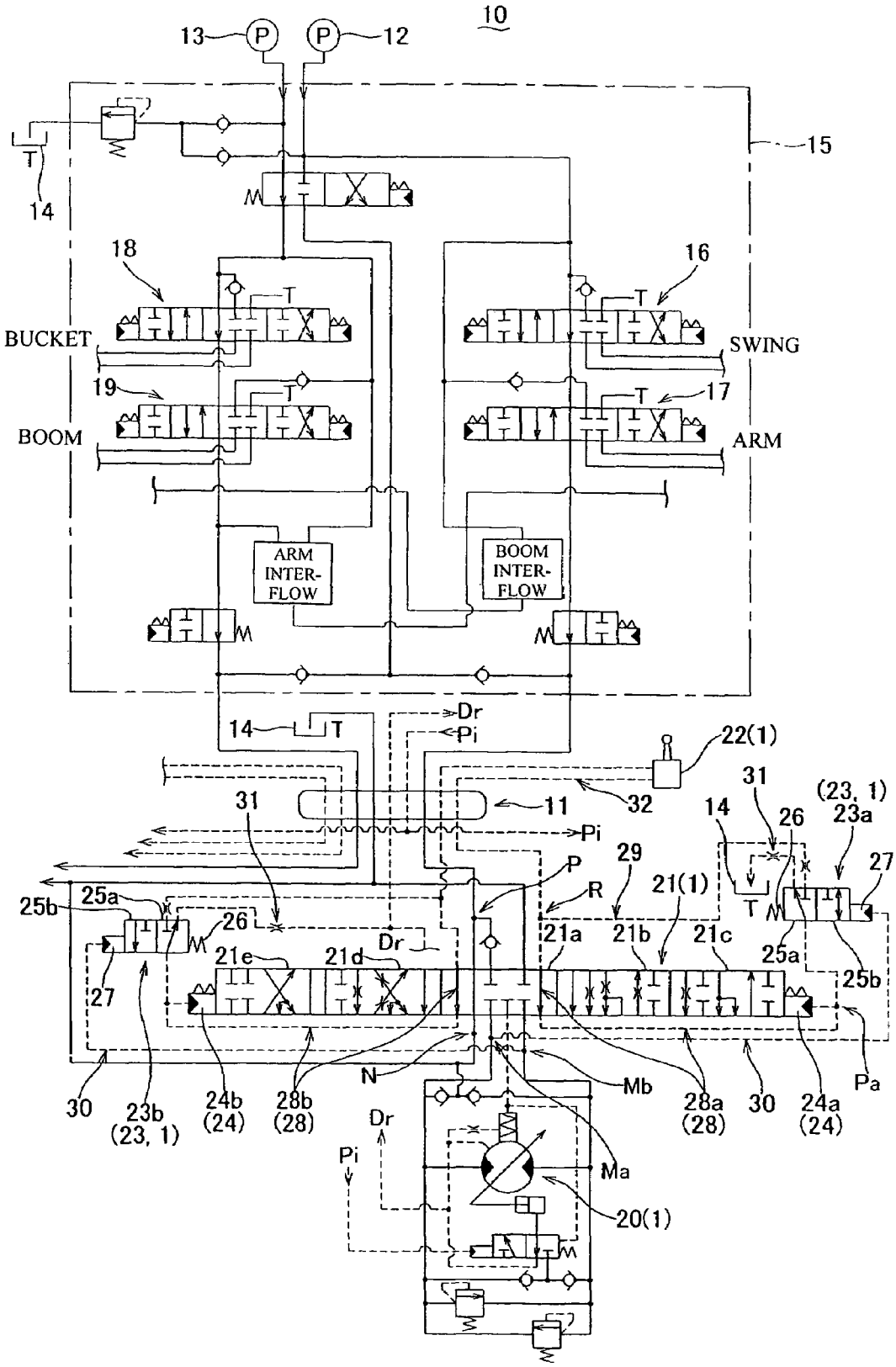
FIG. 1 is a view showing a hydraulic circuit included in a driving motor controlling device of a construction machine related to a first embodiment of the invention.

FIG. 1 is a view showing a hydraulic circuit included in a driving motor controlling device of a construction machine related to a first embodiment of the invention. As shown in FIG. 1, the construction machine in which a hydraulic circuit 10 is disposed has a lower body including a crawler body and an upper body disposed thereon, and a swivel joint 11 is disposed between the lower body and the upper body. In this construction machine, at least two hydraulic pumps such as a first pump 12 and a second pump 13 and a tank 14 are provided in the upper body. In addition, in the upper body, various kinds of hydraulic actuators to which hydraulic oil is fed from the pumps 12 and 13 are provided. In the lower body, a driving motor connected to the pumps 12 and 13 and the tank 14 through the swivel joint 11 is provided. In addition, in this construction machine, a right driving motor 20 and a left driving motor are provided, but only the right driving motor 20 is shown in FIG. 1. In the upper body, a bucket cylinder for operating a bucket, a boom cylinder for operating a boom, a circling (swing) motor, and an arm cylinder for operating an arm are provided as hydraulic actuators different from the driving motor.

Furthermore, as shown in FIG. 1, the hydraulic circuit 10 of the construction machine includes a main control valve 15 provided in the upper body and a driving motor controlling device 1 of the construction machine related to the present embodiment (hereinafter, referred to as driving motor controlling device 1).

The main control valve 15 includes a swing direction switching valve 16 for controlling the feed of hydraulic oil into the circling motor, an arm direction switching valve 17 for controlling the feed of the hydraulic oil into the arm cylinder, a bucket direction switching valve 18 for controlling the feed of the hydraulic oil into the bucket cylinder, and a boom direction switching valve 19 for controlling the feed of the hydraulic oil into the boom cylinder. In addition, the swing direction switching valve 16 and the arm direction switching valve 17 are connected to the downstream of the first pump 12 and the bucket direction switching valve 18 and the boom direction switching valve 19 are connected to the downstream of the second pump 13.

The driving motor controlling device 1 has the right driving motor 20 and the left driving motor. Furthermore, the driving motor controlling device 1 has a motor control valve 21, a remote control valve 22, a pilot pressure control valve 23 (23*a* and 23*b*), all of which are included in the right driving motor 20, and a motor control valve, a remote control valve, and a pilot pressure control valve, all of which are not shown and are included in the left driving motor (In FIG. 1, only those included in the right driving motor 20 are shown). In addition, in the following description on the driving motor controlling device 1, only the right driving motor 20 and the motor control valve 21 thereof will be described, and the left driving motor and the motor control valve thereof will be omitted in order to avoid repetition.

The driving motor 20 of the driving motor controlling device 1 is disposed in the lower body as described above and the motor control valve 21 and the pilot pressure control valve 23 are also disposed in the lower body. Meanwhile, the remote control valve 22 is disposed in the upper body. In addition, the motor control valve 21 is integrally mounted in the driving motor 20. Furthermore, the motor control valve 21 is tandem-connected or serial-connected to the control valves 16, 17, 18, and 19 of the other hydraulic actuators and provided at the downstream of the control valves 16 to 19 of the other hydraulic actuators.

The motor control valve 21 switches a state for connecting the pumps 12 and 13 and the tank 14 to the driving motor 20 such that the driving motor 20 is controlled to any one of a stop state, a normal rotation state (a state that the construction machine rotates forward), and a reverse rotation state (a state that the construction machine rotates backward). The motor control valve 21 has a neutral position 21*a*, normal rotation positions 21*b* and 21*c*, and reverse rotation positions 21*d* and

21*e*. When the motor control valve 21 is switched to the neutral position 21*a*, the driving motor 20 is in the stop state. When the driving motor control valve 21 is switched to the normal rotation position 21*b* (or 21*c*), the driving motor 20 is in the normal rotation state, and, when the driving motor control valve 21 is switched to the reverse rotation position 21*d* (or 21*e*), the driving motor 20 is in the reverse rotation state. As described below, the motor control valve 21 is switched to any one of the neutral position 21*a*, the normal rotation positions 21*b* and 21*c*, and the reverse rotation positions 21*d* and 21*e*, based on a command from the remote control valve 22 and a pressure of an inflow side of the hydraulic oil into the driving motor 20.

In addition, a pilot chamber 24 (24*a* and 24*b*) on which a pilot pressure for switching the motor control valve 21 acts are provided in the motor control valve 21. The pilot pressure acts on the pilot chamber 24*a* such that the motor control valve 21 is switched in the order of the neutral position 21*a*, the normal rotation position 21*b*, and the normal rotation position 21*c*, and pilot pressure acts on the pilot chamber 24*b* such that the motor control valve 21 is switched in the order of the neutral position 21*a*, the reverse rotation position 21*d*, and the reverse rotation position 21*e*. The pilot pressure which acts on the pilot chamber 24 is generated by the remote control valve 22. In other words, the remote control valve 22 configures a control device for generating a command due to the pilot pressure based on the manipulation of an operator (not shown) of the construction machine. In addition, the pilot chamber 24 configures a first pilot chamber in the present embodiment.

Furthermore, the driving motor controlling device 1 includes a pilot pressure control valve 23 for switching a connection state between the remote control valve 22 and the pilot chamber 24 of the motor control valve 21, a spring 26 and a pilot chamber 27 provided in the pilot pressure control valve 23, and a starting passage 28.

The pilot pressure control valve 23 includes a pilot pressure control valve 23*a* for switching the connection state between the remote control valve 22 and the pilot chamber 24*a* and a pilot pressure control valve 23*b* for switching the connection state between the remote control valve 22 and the pilot chamber 24*b*. In addition, the pilot pressure control valve 23 includes a discharge position 25*a* for connecting the pilot chamber 24 to the tank 14 and a feed position 25*b* for connecting a passage 29 in which the pilot pressure is induced from the remote control valve 22 to the pilot chamber 24.

The spring 26 is disposed at one side of the pilot pressure control valve 23 and biases the pilot pressure control valve 23 in a direction in which the pilot pressure control valve 23 is switched to the discharge position 25*a*. Meanwhile, the pilot chamber 27 is disposed at the other side of the pilot pressure control valve 23. The pressure of the inflow side of the hydraulic oil into the driving motor 20 acts on the pilot chamber 27 through the passage 30 such that the pilot pressure control valve 23 is biased in a direction in which the pilot pressure control valve 23 is switched to the feed position 25*b*. In addition, the pilot chamber 27 configures a second pilot chamber in the present embodiment.

The motor control valve 21 is switched and operated by switching the pilot pressure control valve 23 by the pilot pressure control valve 23, the spring 26, and the pilot chamber 27 having the above-described configuration. For example, when the pressure of the inflow side of the hydraulic oil into the driving motor 20 acts on the pilot chamber 27 of the pilot pressure control valve 23*a* and thus the pilot pressure control valve 23*a* is switched to the feed position 25*b* against the bias force of the spring 26, the pilot pressure from the remote control valve 22 induced through the passage 29 acts on the pilot chamber 24*a*. Accordingly, the motor control valve 21 is switched to the normal rotation position 21*b* or 21*c*. Meanwhile, when the bias force due to the action of the hydraulic oil on the pilot chamber 27 is reduced with respect to the bias force of the spring 26 and thus the pilot pressure control valve 23*a* is switched to the discharge position 25*a*, the hydraulic oil which acts the pilot pressure on the pilot chamber 24*a* is discharged to the tank 14 through an throttle 31. In addition, the motor control valve 21 is switched in the order of the normal rotation position 21*c*, the normal rotation position 21*b*, and the neutral position 21*a*.

The starting passage 28 (28*a* and 28*b*) connects the remote control valve 22 to the pilot chamber 24 through the motor control valve 21. The starting passage 28*a* connects the remote control valve 22 to the pilot chamber 24*a* and the starting passage 28*b* connects the remote control valve 22 to the pilot chamber 24*b*. Furthermore, a portion of the starting passage 28 is configured in a passage formed in the motor control valve 21 and connects the remote control valve 22 to the pilot chamber 24 when the motor control valve 21 is in the neutral position 21*a*. In addition, when the motor control valve 21 is in the normal rotation positions 21*b* and 21*c*, the starting passage 28*a* is blocked and, when the motor control valve 21 is in the reverse rotation positions 21*d* and 21*e*, the starting passage 28*b* is blocked.

Next, an operation of the driving motor controlling device 1 will be described. FIG. 1 shows a state which the motor control valve 21 is in the neutral position 21*a*. In this state, the driving motor 20 is in the stop state. When the construction machine including the driving motor controlling device 1 is operated in an environment in which a temperature is low, such as a cold region in winter, a warming up operation is first performed. Upon the warming up operation, the pumps 12 and 13 are operated and the hydraulic oil is circulated in a state that the hydraulic oil is not fed to the hydraulic actuators (in a state that the control valves are not operated).

At this time, the hydraulic oil discharged from the pumps 12 and 13 becomes warm while being circulated to the tank 14 through the control valves 16, 17, 18, 19, and 21. Then, the hydraulic oil is also circulated in a path which reaches the tank 14 disposed in the upper body through the swivel joint 11 and the motor control valve 21. In other words, upon the warming up operation, the hydraulic oil discharged from the pumps 12 and 13 is circulated to the motor control valve 21 disposed in the lower body in which the driving motor 20 is disposed. Accordingly, the motor control valve 21 also becomes warm by the hydraulic oil which becomes warm by circulation and the driving motor 20 integrally formed with the motor control valve 21 also becomes warm.

After the warming up operation, the left and right driving motors are initiated and the construction machine begins to be driven. Here, when the driving motor is operated in the normal rotation state such that the construction machine is moved forward, the right driving motor 20 will be described. In this case, first, the remote control valve 22 is manipulated by the operator such that a pilot pressure of a forward drive command (driving command of the normal rotation direction) which acts through the passage 32 is generated.

When the pilot pressure of the forward drive command is generated, since the motor control valve 21 is in the neutral position 21*a*, the starting passage 28*a* is in a continuous state and the pilot pressure acts on the pilot chamber 24*a* through the starting passage 28*a*. At this time, the pilot pressure control valve 23*a* which is at the downstream of the starting passage 28*a* is in the discharge position 25*a* by the bias force of the spring 26, because the pressure of an inflow side of the hydraulic oil into the driving motor 20 is low. Thus, the hydraulic oil which generates the pilot pressure acting on the pilot chamber 24*a* through the starting passage 28*a* is discharged to the tank 14. However, since the throttle 31 is provided in a path which reaches the tank 14 such that an opening degree thereof is adequately reduced, the pilot pressure required for switching and operating the motor control valve 21 is controlled to act on the pilot chamber 24*a* through the starting passage 28*a*.

When the pilot pressure acts on the pilot chamber 24*a* through the starting passage 28*a*, the motor control valve 21 is switched to the normal rotation position 21*b*. Accordingly, the hydraulic oil is fed in a direction in which the driving motor 20 rotates in the normal rotation state and thus the construction machine begins to be moved forward. In addition, when the hydraulic oil begins to be fed to the driving motor 20, since the pressure of the inflow side of the hydraulic oil into the driving motor 20 increases, the increased pressure acts on the pilot chamber 27 of the pilot pressure control valve 23*a* through the passage 30. Accordingly, the pilot pressure control valve 23*a* is switched to the feed position 25*b* against the bias force of the spring 26 and the pilot pressure acts on the pilot chamber 24*a* through the passage 29 such that the motor control valve 21 is switched to and held in the normal position 21*b* or 21*c*. In addition, in the state that the motor control valve 21 is switched to the normal position 21*b* or 21*c*, the starting passage 28*a* is blocked. In the driving motor controlling device 1, the remote control valve 22 and the pilot chamber 24 are connected to each other through the starting passage 28 until the pilot pressure control valve 23 is switched to the feed position 25*a*, and the starting passage 28 is blocked by the motor control valve 21 when the pilot pressure control valve 23 is switched to the feed position 25*a*.

Figure 2:
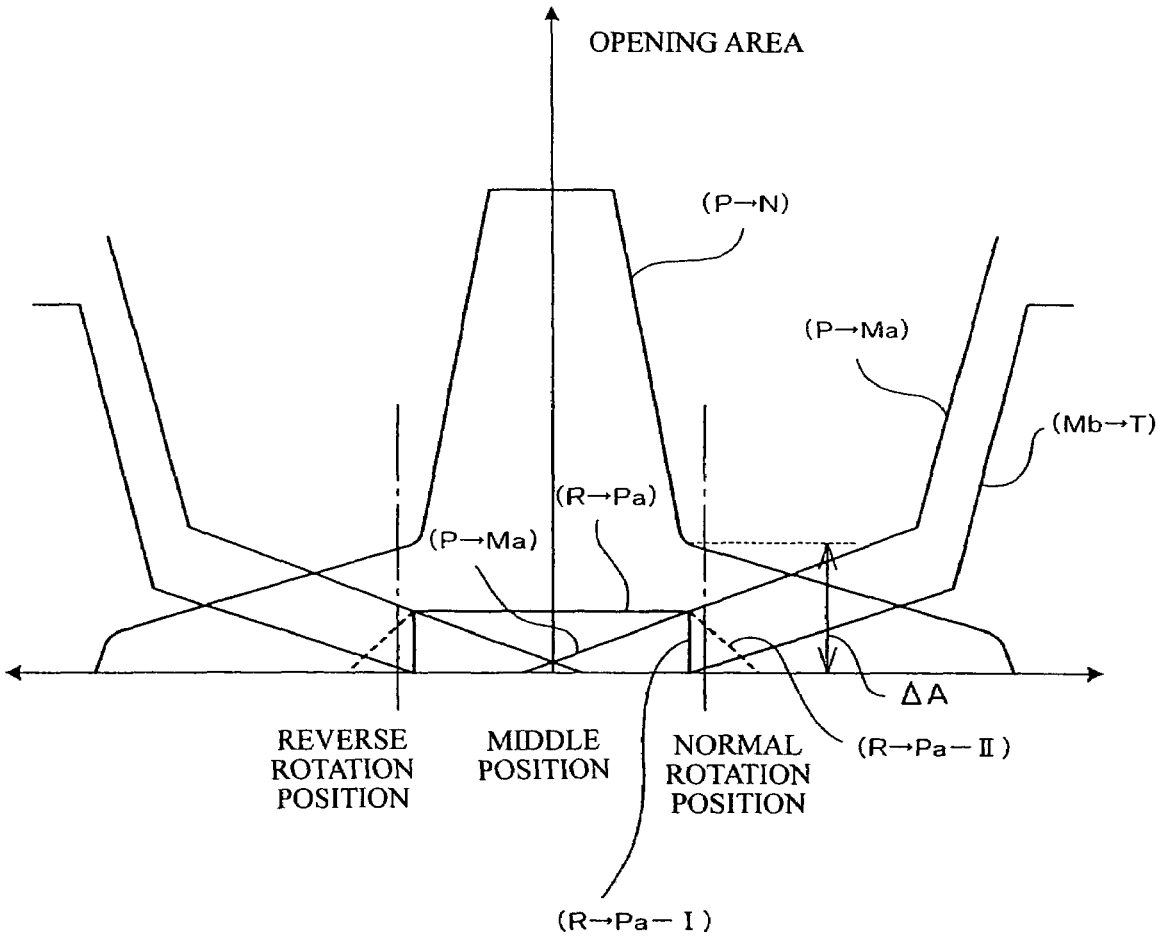
FIG. 2 is a view explaining a change in an opening area of a passage when a position of a motor control valve is switched in the driving motor controlling device shown in FIG. 1.

Now, the switching of the motor control valve 21 from the neutral position 21*a* will be described in detail. FIG. 2 is a view explaining a change in an opening area of a passage when a motor control valve 21 which is a center bypass control valve is switched from the neutral position 21*a* to the normal rotation positions 21*b* and 21*c* or the reverse rotation positions 21*d* and 21*e*. In addition, in FIG. 2, the change in the opening area of a passage (P→N) which is a center bypass passage between a point P and a point N, a passage (P→Ma) between the point P and a point Ma (an inflow side of the hydraulic oil upon the normal rotation of the driving motor 20), a passage (Mb→T) between a point Mb (an outflow side of the hydraulic oil upon the normal rotation of the driving motor 20) and the tank 14, and a passage (R→Pa) which is the starting passage 28 between a point R and a point Pa. Furthermore, in FIG. 2, as the change in the opening area of the passage (R→Pa), a pattern I and a pattern II are exemplified. The pattern I shows a case where the starting passage 28 is formed in the motor control valve 21 such that the opening area is changed along a locus denoted by (R→Pa-I) in the drawing. Meanwhile, the pattern II shows a case where the starting passage 28 is formed in the motor control valve 21 such that the opening area is changed along a locus denoted by a dotted line (R→Pa-II)

The motor control valve 21 begins to be switched from the neutral position 21*a* to the normal rotation positions 21*b* and 21*c*, the opening degree of the center bypass passage (P→N) decreases and the opening degree of the passage (P→Ma) of the inflow side of the driving motor 20 increases. At this time, the starting passage 28, that is, passage (R→Pa), is in the continuous state. In addition, in the pattern I, when the motor control valve 21 is switched from the neutral position 21*a* to the normal rotation positions 21*b* and 21*c*, the passage (R→Pa) which is the starting passage 28 is blocked and the passage (Mb→T) between the outflow side of the hydraulic oil from the driving motor 20 and the tank 14 is then connected. Meanwhile, in the pattern II, when the motor control valve 21 is switched from the neutral position 21*a* to the normal rotation positions 21*b* and 21*c*, the passage (Mb→T) is connected and the passage (R→Pa) which is the starting passage 28 is then blocked.

Furthermore, even in any one of the pattern I and the pattern II, when the starting passage 28 is blocked, the opening degree of the center bypass passage (P→N) is set to a predetermined opening degree ΔA. The opening degree ΔA is set such that a pressure which can switch the pilot pressure control valve 23*a* to the feed position 25*b* against the bias force of the spring 26 is generated in the inflow side of the driving motor 20 and acts on the pilot chamber 24*a* even in a state that a discharge amount of the pumps 12 and 13 is a minimum.

In the above-described driving motor controlling device 1, when the warming up operation of the construction machine is performed, the hydraulic oil discharged from the pumps 12 and 13 is circulated to the motor control valve 21 disposed in the lower body in which the driving motor 20 is disposed. Accordingly, the motor control valve 21 becomes warm by the hydraulic oil which becomes warm by circulation and the driving motor 20 integrally formed with the motor control valve 21 also becomes warm. Thus, according to the driving motor controlling device 1, when the construction machine begins to be driven after the warming up operation, the heat balance of the driving motor 20 is prevented from being lost and thus the operation fault or failure of the driving motor 20 due to the difference in the thermal expansion in the driving motor 20 can be suppressed.

In addition, when the construction machine is switched from the driving state to the stop state on the downhill road, the outflow side of the hydraulic oil from the driving motor 20 has a high pressure. Accordingly, the existing driving motor controlling device of the construction machine need use a pipe which has a high strength to bear up against the high pressure between the motor control valve and the driving motor. Thus, an expensive pipe is required. However, according to the driving motor controlling device 1, since the motor control valve 21 is integrally formed with the driving motor 20, a pipe for connecting the motor control valve 21 and the driving motor 20 is not required.

Furthermore, in the driving motor controlling device 1, the motor control valve 21 is tandem-connected (or serial-connected) to the control valves of the hydraulic actuators different from the driving motor 20 and is provided at the downstream of the control valves 16 to 19 of the hydraulic actuators. Accordingly, the hydraulic oil fed from the pumps 12 and 13 passes through the control valves 16 to 19 of the hydraulic actuators and is fed to the motor control valve 21. Thus, pressure loss due to the length of the pipe which more becomes longer by a length corresponding to the motor control valve 21 disposed in the lower body does not affect the hydraulic actuators. Therefore, it is possible to suppress the energy efficiency from be reduced.

In the driving motor controlling device 1, the remote control valve 22 is connected to the pilot chamber 24 through the starting passage 28 even until the pilot pressure control valve 23 is switched to the feed position 25*b*. Accordingly, by providing the throttle 31, the pilot pressure control valve 23 can be formed such that the opening in the discharge position 25*a* becomes narrower and thus a sufficient pilot pressure can act on the pilot chamber 24 even until the pilot pressure control valve is switched to the feed position 25*b*. Thus, it is possible to prevent the rising of the driving speed from be delayed due to the delay of the switching operation in an initial state of a time when the motor control valve 21 is switched from the neutral position 21*a*. After the pilot pressure control valve 23 is switched to the feed position 25*b*, the starting passage 28 is blocked by the motor control valve 21 and thus the pilot pressure acts on the pilot chamber 24 only through the pilot pressure control valve 23.

In the driving motor controlling device 1, when the construction machine begins to be self-propelled and thus the pressure of the inflow side of the hydraulic oil into the driving motor 20 is reduced, the pressure of the hydraulic oil acting on the pilot chamber 27 is reduced. Accordingly, the pilot pressure control valve 23 is switched to the discharge position 25*a* by the bias force of the spring 26 and thus the passage between the remote controller valve 22 and the pilot chamber 24 more becomes narrower or is blocked. Thus, the motor control valve 21 is moved toward the neutral position 21*a* and thus the outflow side of the hydraulic oil from the driving motor 20 becomes narrower. Accordingly, it is possible to suppress the cavitation of the driving motor 20 from being created.

Accordingly, according to the driving motor controlling device 1, it is possible to more surely suppress the cavitation from being created although the counterbalance valve is not used in the driving motor controlling device of the construction machine and to prevent the rising of the driving speed upon the start-up from being delayed.

Furthermore, in the driving motor controlling device 1 which is formed such that the opening area of the starting passage 28 in the motor control valve 21 is changed to the pattern I, when the motor control valve 21 is switched from the neutral position 21*a*, the starting passage 28 is first blocked and the outflow side of the driving motor 20 and the tank 14 are connected to each other. Accordingly, even when the construction machine begins to be self-propelled upon the switching operation and thus the pressure of the outflow side of the driving motor 20 is reduced, the outflow side of the driving motor 20 is blocked by the motor control valve 21 until the starting passage 28 is blocked. Thus, the cavitation can be more suppressed from being created.

In addition, in the driving motor controlling device 1 which is formed such that the opening area of the starting passage 28 in the motor control valve 21 is changed to the pattern II, the construction machine begins to be self-propelled upon the switching operation and the pressure of the outflow side of the driving motor 20 is reduced. Thus, although the pilot pressure control valve 23 is not sufficiently switched to the feed position 25*b*, since the pilot pressure acts on the pilot chamber 24 through the starting passage 28, the outflow side of the driving motor 20 in the motor control valve 21 is not rapidly blocked and thus impact can be suppressed from being generated.

Moreover, in the driving motor controlling device 1, the opening degree of the center bypass passage (P→N) is set to the predetermined opening degree ΔA. Accordingly, since a path in which the pilot pressure acts on the pilot chamber 24 can be smoothly switched to a passage from the starting passage 28 through the pilot pressure control valve 23, impact generated upon the start-up of the driving motor 20, that is, impact generated when switching the pilot pressure control valve 23 can be reduced. In addition, in the driving motor controlling device 1 which is formed such that the opening area of the starting passage 28 in the motor control valve 21 is changed to the pattern II, before the driving motor 20 is initiated and the outflow side is opened, the path in which the pilot pressure acts on the pilot chamber 24 is switched to the passage through the pilot pressure control valve 23. Thus, it is possible to prevent impact from being generated in the driving motor 20 when switching the pilot pressure control valve 23.

Second Embodiment

Figure 3:
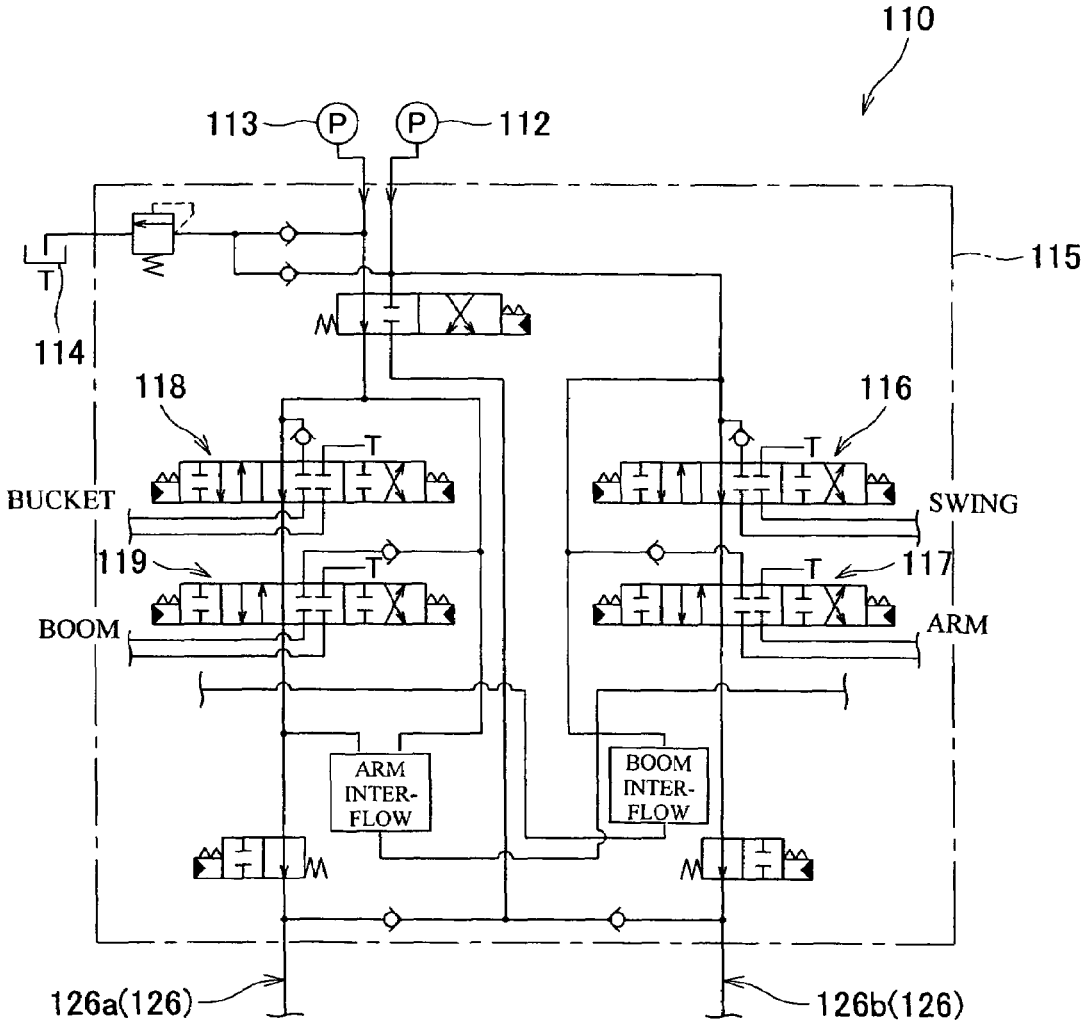
FIG. 3 is a view showing a hydraulic circuit included in a driving motor controlling device of a construction machine related to a second embodiment of the invention.
Figure 4:
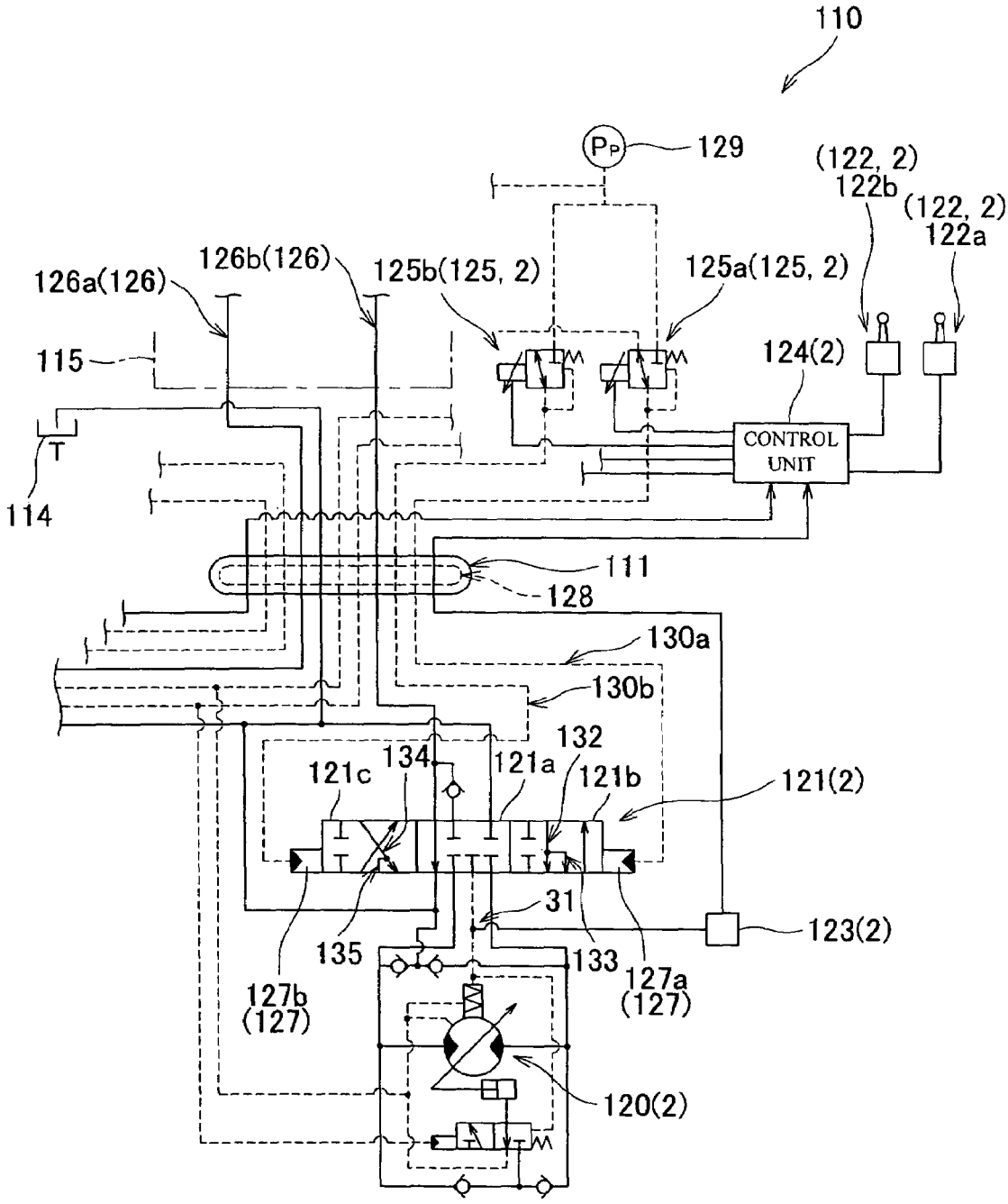
FIG. 4 is a view showing the hydraulic circuit included in the driving motor controlling device of the construction machine related to the second embodiment of the invention.

Next, a second embodiment of the invention will be described. FIGS. 3 and 4 are views showing a hydraulic circuit included in a driving motor controlling device of a construction machine related to a second embodiment of the invention. The construction machine having the hydraulic circuit 110 shown in FIGS. 3 and 4 includes a lower body including a crawler body and an upper body disposed thereon, and a swivel joint 111 is interposed between the upper body and the lower body (see FIG. 2).

In this construction machine, similar to the construction machine described in the first embodiment, at least two hydraulic pumps, such as a first pump 112 and a second pump 113, and a tank 114 are disposed in the upper body. In addition, in the upper body, various kinds of hydraulic actuators to which the hydraulic oil is fed from the pumps 112 and 113 are provided. In the lower body, a driving motor connected to the pumps 112 and 113 and the tank 114 through the swivel joint 111 is provided. In addition, in this construction machine, a right driving motor 120 and a left driving motor are provided, but only the right driving motor 120 is shown in FIG. 4. Meanwhile, in the upper body, a bucket cylinder for operating a bucket, a boom cylinder for operating a boom, and a circling (swing) motor, an arm cylinder for operating an arm are provided as hydraulic actuators different from the driving motor.

Furthermore, the hydraulic circuit 110 of the construction machine includes a main control valve 115 provided in the upper body as shown in FIG. 3, and a driving motor controlling device 2 of the construction machine related to the present embodiment (hereinafter, referred to as driving motor controlling device 2) as shown in FIG. 4. In addition, the hydraulic oil from the pumps 112 and 113 is first fed to the main control valve 115 and the driving motor controlling device 2 located at the downstream of the main control valve 115 through the main control valve 115 and the swivel joint 111.

As shown in FIG. 1, similar to the main control valve described in the first embodiment, the main control valve 115 includes a swing direction switching valve 116 for controlling the feed of hydraulic oil into the circling motor, an arm direction switching valve 117 for controlling the feed of the hydraulic oil into the arm cylinder, a bucket direction switching valve 118 for controlling the feed of the hydraulic oil into the bucket cylinder, and a boom direction switching valve 119 for controlling the feed of the hydraulic oil into the boom cylinder. In addition, the swing direction switching valve 116 and the arm direction switching valve 117 are connected to the downstream of the first pump 112 and the bucket direction switching valve 118 and the boom direction switching valve 119 are connected to the downstream of the second pump 113.

As shown in FIG. 4, the driving motor controlling device 2 has the right driving motor 120 and the left driving motor. Furthermore, the driving motor controlling device 2 has a motor control valve 121 corresponding to the right driving motor 120, an electrical remote controller 122 (122*a* and 122*b*), a detector 123, a control unit 124, and an electro-hydraulic valve 125 (125*a* and 125*b*). In FIG. 4, only the motor control valve 121, the detector 123, and the electro-hydraulic valve 125 corresponding to the right driving motor 120 are shown. In the following description on the driving motor controlling device 2, only the right driving motor 120 and the motor control valve 121 thereof will be described, and the left driving motor and the motor control valve thereof will be omitted in order to avoid repetition.

Furthermore, a center bypass passage 126 (126*a* and 126*b*) in the main control valve 115 is connected to the channels of the left and right driving motors through the swivel joint 111. In other words, the center bypass passage 126*a* for connecting the bucket direction switching valve 118 to the boom direction switching valve 119 in series is connected to the channel of the left driving motor and the center bypass passage 126*b* for connecting the swing direction switching valve 116 to the arm direction switching valve 117 in series is connected to the channel of the right driving motor 120.

The driving motor 120 of the driving motor controlling device 2 is disposed in the lower body as described above and the motor control valve 121 and the detector 123 are also disposed in the lower body. Meanwhile, the electrical remote controller 122, the control unit 124, and the electro-hydraulic valve 125 are disposed in the upper body. In addition, the motor control valve 121 is integrally mounted with the driving motor 120. Furthermore, the motor control valve 121 is tandem-connected or serial-connected to the control valves 116 and 117 of the hydraulic actuators and connected to the center bypass passage 126*b* at the downstream of the control valves 116 and 117 of the hydraulic actuators.

The motor control valve 121 switches a state for connecting the pumps 112 and 113 and the tank 114 to the driving motor 120 such that the driving motor 120 is in any one of a stop state, a normal rotation state (a state that the construction machine rotates forward), and a reverse rotation state (a state that the construction machine rotates backward). The motor control valve 121 has a neutral position 121*a*, a normal rotation position 121*b*, and a reverse rotation position 121*c*, as shown in FIG. 4. When the motor control valve 121 is switched to the neutral position 121*a*, the driving motor 120 is in the stop state. When the driving motor control valve 121 is switched to the normal rotation position 121*b*, the driving motor 120 is in the normal rotation state, and, when the driving motor control valve 121 is switched to the reverse rotation position 121*c*, the driving motor 120 is in the reverse rotation state. The motor control valve 121 is switched to any one of the neutral position 121*a*, the normal rotation position 121*b*, and the reverse rotation position 121*c*, based on a command from the electrical remote controller 122 and a pressure of an inflow side of the hydraulic oil into the driving motor 120, as described below.

In addition, a pilot chamber 127 (127*a* and 127*b*) on which a pilot pressure for switching and operating the motor control valve 121 acts is provided in the motor control valve 121. The pilot pressure acts on the pilot chamber 127*a* such that the motor control valve 121 is switched from the neutral position 121*a* to the normal rotation position 121*b*, and pilot pressure acts on the pilot chamber 127*b* such that the motor control valve 121 is switched from the neutral position 121*a* to the reverse rotation position 121*c*. The pilot pressure which acts on the pilot chamber 127 is generated in the electro-hydraulic valve 125 as described below.

The electrical remote controller 122 (hereinafter, referred to as remote controller 122) is provided as a control device for converting an amount (for example, the control amount of a control lever) controlled by an operator (not shown) into an electrical signal. The remote controller 122*a* is used for manipulating the motor control valve 121 of the right driving motor 120 and the remote controller 122*b* is used for manipulating the motor control valve of the left driving motor. The remote controllers 122*a* and 122*b* are connected to the control unit 124 such that the electrical signal corresponding to the control amount is input to the control unit 124.

The detector 123 is provided as a pressure sensor mounted in the driving motor 120. The detector 123 detects the pressure of the inflow side of the hydraulic oil into the driving motor 120 and switches the pressure to an electrical signal. The detector 123 is connected to the control unit 124 through a snap ring 128 disposed in the swivel joint 111. In addition, similar to the driving motor 120, a detector (not shown) similar to the detector 123 is also mounted in the left driving motor (not shown).

The control unit 124 outputs a control signal of the electro-hydraulic valve 125 for the motor control valve 121 and a control signal of the electro-hydraulic valve for the motor control valve of the left driving motor, based on the electrical signal from the remote controller 122 and the electrical signals from the detector 123 and the detector for the left driving motor. The control unit 124 includes a CPU (central processing unit), a memory (ROM (read only memory)) and RAM (random access memory), and a current control circuit, all of which are not shown.

The electro-hydraulic valve 125 generates a pilot pressure which operates the motor control valve 121 based on the control signal from the control unit 124. In other words, the electro-hydraulic valve 125 is connected to the motor control valve 121 through the swivel joint 111 and magnetized by the energization of a coil portion, based on the control signal from the control unit 124, such that the pilot hydraulic oil fed from the pilot pump 129 acts on the pilot chamber 127 of the motor control valve 121. Meanwhile, when the electro-hydraulic valve 125 is demagnetized, an elastic force is applied and the pilot hydraulic oil which acts on the pilot chamber 127 is discharged to the tank 114.

The electro-hydraulic valve 125 includes an electro-hydraulic valve 125*a* for the normal rotation and an electro-hydraulic valve 125*b* for the reverse rotation. For example, when the remote controller 122*a* outputs the electrical signal of a forward drive command (driving command of a normal rotation direction), the electro-hydraulic valve 125*a* is magnetized based on the control signal from the control unit 124. In addition, when the electro-hydraulic valve 125*a* is magnetized, the pilot hydraulic oil of the pilot pump 129 acts on the pilot chamber 127*a* through a pilot passage 130*a*, that is, a pilot pressure is in the pilot chamber 127*a*, and thus the motor control valve 121 is switched from the neutral position 121*a* to the normal rotation position 121*b*. Meanwhile, when the remote controller 122*a* outputs the electrical signal of a reverse drive command (driving command of a reverse rotation direction), the electro-hydraulic valve 125*b* is magnetized based on the control signal from the control unit 124, a pilot pressure is in the pilot chamber 127*c*, and thus the motor control valve 121 is switched from the neutral position 121*a* to the reverse rotation position 121*c*. In addition, similar to the motor control valve 121, even in the motor control valve of the left driving motor (not shown), an electro-hydraulic valve (not shown) similar to the electro-hydraulic valve 125 for generating the pilot pressure is provided.

In addition, the motor control valve 121 of the driving motor controlling device 2 includes a detecting port 131 which is connected to the detector 123 and induces a pressure of the inflow side of the driving motor 120, which is detected by the detector 123. The detecting port 131 is communicated with a passage 132 of the inflow side of the driving motor through a continuous passage 133 when the motor control valve 121 is switched to the normal rotation position 121*b* and is communicated to a passage 134 of the inflow side of the driving motor through a continuous passage 135 when the motor control valve 121 is switched to the reverse position 121*c*. The detecting port 131 is connected to the passage 132 which becomes the inflow side of the driving motor in the normal rotation state and connected to the passage 134 which becomes the inflow side of the driving motor in the reverse rotation state.

Furthermore, in the driving motor controlling device 2, when the driving motor 120 is in the stop state, a negative brake (not shown) which is operated in order to maintain the stop state is connected to the detecting port 131.

Next, an operation of the driving motor controlling device 2 will be described. The state shown in FIG. 4 shows a state that the motor control valve 121 is in the neutral position 121*a*. In this state, the driving motor 120 is in the stop state. When the construction machine having the driving motor controlling device 2 is operated in an environment in which a temperature is low, such as a cold region in winter, a warming up operation is first performed. Upon the warming up operation, the pumps 112 and 113 are initiated and the hydraulic oil is circulated in a state that the hydraulic oil is not fed into the hydraulic actuators (in a state that the control valves are not operated).

At this time, the hydraulic oil discharged from the pumps 112 and 113 becomes warm while being circulated to the tank 114 through the control valves 116, 117, 118, 119, and 121. Then, the hydraulic oil is also in a path which reaches the tank 114 disposed in the upper body through the swivel joint 111 and the motor control valve 121. In other words, upon the warming up operation, the hydraulic oil discharged from the pumps 112 and 113 is circulated to the motor control valve 121 disposed in the lower body in which the driving motor 120 is disposed. Accordingly, the motor control valve 121 becomes warm by the hydraulic oil which becomes warm by circulation, and the driving motor 120 integrally formed with the motor control valve 121 also becomes warm.

After the warming up operation, the left and right driving motors are initiated and the construction machine begins to be driven. Here, when the driving motor is switched to the normal rotation state such that the construction machine is moved forward, the right driving motor 120 will be described. In this case, first, the remote controller 122*a* is manipulated by the operator such that the electrical signal of the forward drive command is output, and thus, as described above, the electro-hydraulic valve 125*a* generates the pilot pressure in the pilot chamber 127*a* of the motor control valve 121 based on the control signal from the control unit 124. Thus, the motor control valve 121 is switched from the neutral position 121*a* to the normal rotation position 121*b* such that the hydraulic oil is fed in a direction in which the driving motor 120 rotates in the normal rotation state and the construction machine begins to be moved forward.

Furthermore, in the driving motor controlling device 2, the pressure of the inflow side of the driving motor 120 is always detected by the detector 123 to be input to the control unit 124 as a detecting signal (electrical signal) and a change in the pressure is also detected by the control unit 124. Accordingly, when the construction machine begins to be self-propelled on the downhill road and thus the pressure of the inflow side of the driving motor 120 is reduced, the pressure is detected by the control unit 124 and the electro-hydraulic valve 125 is controlled such that the motor control valve 121 returns to the neutral position 121*a* based on the control signal output from the control unit 124. For example, when the motor control valve 121 is switched to the normal rotation position 121*a* and the pressure is reduced to a value lower than a predetermined threshold due to the self-propulsion of the construction machine, the electro-hydraulic valve 125*a* is demagnetized based on the control signal from the control unit 124 and thus the motor control valve 121 is switched to the neutral position 121*a*. Thus, it is possible to suppress creation of cavitation of the driving motor 120 which is generated by the reduction of the pressure of the inflow side of the driving motor due to the self-propulsion of the construction machine from.

In the above-described driving motor controlling device 2, when the warming up operation of the construction machine is performed, the hydraulic oil discharged from the pumps 112 and 113 is circulated to the motor control valve 121 disposed in the lower body in which the driving motor 120 is disposed. Accordingly, the motor control valve 121 becomes warm by the hydraulic oil which becomes warm by circulation, and the driving motor 120 integrally formed with the motor control valve 121 also becomes warm. Thus, according to the driving motor controlling device 2, the heat balance of the driving motor 120 is prevent from being lost when the construction machine begins to be driven after the warming up operation, and thus the operation fault or failure of the driving motor 120 due to the difference in the thermal expansion in the driving motor 120 can be suppressed.

In addition, when the construction machine is switched from the driving state to the stop state on the downhill road, the outflow side of hydraulic oil from the driving motor 120 has a high pressure. Accordingly, the existing driving motor controlling device of the construction machine need use a pipe which has a high strength to bear up against the high pressure between the motor control valve and the driving motor. Thus, an expensive pipe is required. However, according to the driving motor controlling device 2, since the motor control valve 121 is integrally formed with the driving motor 120, a pipe for connecting the motor control valve 121 to the driving motor 120 is not required.

Furthermore, according to the driving motor controlling device 2, the electro-hydraulic valve 125 is controlled to generate the pilot pressure based on a command from the electrical remote controller 122 by the control unit 124 and the result of detecting the pressure of the inflow side of the driving motor 120 by the detector 123. Thus, the motor control valve 121 can be operated by the pilot pressure. Accordingly, response delay is low and the motor control valve 121 can be accurately or rapidly operated based on the pressure of the inflow side of the driving motor 120 and the command from the electrical remote controller 122 which is the control device.

Furthermore, according to the driving motor controlling device 2, since the detector 123 for detecting the pressure of the inflow side of the driving motor 120 is mounted in the driving motor 121, detection of the pressure can be more suppressed from being delayed, compared with a case where the pipe is provided from the inflow side of the driving motor 120 to the upper body through the swivel joint 111 to be connected to the detector 123. In addition, a response to the change in the pressure of the inflow side of the driving motor 120 is suppressed from being delayed and thus the motor control valve 121 can be rapidly operated with respect to the change in the pressure of the inflow side of the driving motor 120, thereby suppressing cavitation from being created in the driving motor 120. In addition, the response to the change in the pressure of the inflow side of the driving motor 120 is suppressed from being delayed and thus hunting can be suppressed from being generated in the operation of the motor control valve 121.

According to the driving motor controlling device 2, when the motor control valve 121 is in the normal rotation position 121*b*, the passage 132 and the detecting port 131 are communicated with each other through the continuous passage 133, and, when the motor control valve 121 is in the reverse rotation position 121*c*, the passage 134 and the detecting port 131 are communicated with each other through the continuous passage 135. Accordingly, the pressure of the inflow side of the driving motor 120 which is induced to the detector 123 is selected by the motor control valve 121 and thus the passage 132 which becomes the inflow side in the normal rotation position and the passage 134 which becomes the inflow side in the reverse rotation position need not have the respective detectors, thereby sharing the detector.

In addition, according to the driving motor controlling device 2, by combining a port for the negative brake and a port for the detecting port 131, the number of the ports may not increase in mounting the detector 123, thereby preventing the device from being enlarged.

Although the invention has been described in connection with the first and second embodiments of the invention illustrated in the accompanying drawings, it is not limited thereto. It will be apparent to those skilled in the art that various substitutions, modifications and changes may be made thereto without departing from the scope and spirit of the invention.

INDUSTRIAL AVAILABILITY

A driving motor controlling device of a construction machine according to the invention can widely apply to a driving motor controlling device including a driving motor connected to a pump and a tank through a swivel joint and a motor control valve for switching a state for connecting the pump and the tank to the driving motor such that the driving motor is controlled to any one of a stop state, a normal rotation state, and a reverse rotation state.

What is claimed is:

1. A driving motor controlling device of a construction machine, comprising:

a driving motor which is connected to a pump and a tank through a swivel joint; and a motor control valve which switches a state for connecting the pump and the tank to the driving motor such that the driving motor is controlled to a stop state, a normal rotation state, or a reverse rotation state;

wherein the motor control valve has a neutral position for the stop state, a normal rotation position for the normal rotation state, and a reverse rotation position for the reverse rotation state, and is switched to the neutral position, the normal rotation position, or the reverse rotation position, based on a command from a control device manipulated by a operator and a pressure of an inflow side of hydraulic oil into the driving motor;

wherein the driving motor controlling device further comprises:

a remote control valve which is the control device for generating a pilot pressure;

a first pilot chamber which is provided in the motor control valve and on which the pilot pressure for switching and operating the motor control valve acts;

a pilot pressure control valve which switches a connection state between the remote control valve and the first pilot chamber and has a discharge position for connecting the first pilot chamber to the tank and a feed position for connecting the remote control valve to the first pilot chamber;

a spring which is disposed at one side of the pilot pressure control valve to bias the pilot pressure control valve toward the discharge position;

a second pilot chamber which is disposed at the other side of the pilot pressure control valve and on which the pressure of the inflow side acts such that the pilot pressure control valve is biased toward the feed position; and a starting passage which connects the remote control valve to the first pilot chamber through the motor control valve, and wherein the remote control valve is connected to the first pilot chamber though the starting passage until the pilot pressure control valve is switched to the feed position, and the starting passage is blocked by the motor control valve when the pilot pressure control valve is switched to the feed position.

2. The driving motor controlling device according to claim 1, wherein, when the motor control valve is switched from the neutral position to the normal rotation position or the reverse rotation position, the starting passage is blocked and an outflow side of the hydraulic oil from the driving motor is then connected to the tank.

3. The driving motor controlling device according to claim 1, wherein, when the motor control valve is switched from the neutral position to the normal rotation position or the reverse rotation position, an outflow side of the hydraulic oil from the driving motor is connected to the tank and the starting passage is then blocked.

4. The driving motor controlling device according to claim 1, wherein the motor control valve is a center bypass control valve, and an opening degree of a center bypass passage is set such that, when the starting passage is blocked, the pressure which can switch the pilot pressure control valve to the feed position against a bias force of the spring is generated in the inflow side of the driving motor and acts on the second pilot chamber, even in a state that a discharge amount of the pump is a minimum.

* * * * *